US010385526B1

(12) United States Patent
Caval

(10) Patent No.: US 10,385,526 B1
(45) Date of Patent: Aug. 20, 2019

(54) SECURITY BARRIER AND METHODS

(71) Applicant: Jacob Caval, Twin Falls, ID (US)

(72) Inventor: Jacob Caval, Twin Falls, ID (US)

( * ) Notice: Subject to any disclaimer, the term of this patent is extended or adjusted under 35 U.S.C. 154(b) by 0 days.

(21) Appl. No.: 15/914,226

(22) Filed: Mar. 7, 2018

(51) Int. Cl.

| | |
|---|---|
| ***E01F 15/04*** | (2006.01) |
| ***E01F 15/08*** | (2006.01) |
| ***E01F 9/60*** | (2016.01) |
| ***E01F 15/00*** | (2006.01) |
| ***E01F 9/692*** | (2016.01) |

(52) U.S. Cl.
CPC ..... *E01F 9/692* (2016.02); *E01F 15/00* (2013.01); *E01F 9/60* (2016.02); *E01F 15/04* (2013.01); *E01F 15/08* (2013.01)

(58) Field of Classification Search
CPC ..... E01F 9/541; E01F 9/692; E01F 15/0461; E01F 15/086; E01F 15/146; G09F 19/22
See application file for complete search history.

(56) References Cited

U.S. PATENT DOCUMENTS 2,315,516 A * 4/1943 Gray ..... E01F 13/026 256/1
3,567,184 A * 3/1971 Yancey ..... E01F 7/06 256/13.1
4,240,766 A * 12/1980 Smith ..... E01F 9/677 248/160
4,290,585 A * 9/1981 Glaesener ..... E01F 15/146 256/13.1
4,358,090 A * 11/1982 Glaesener ..... E01F 8/0082 181/210
5,257,489 A * 11/1993 Angelette ..... E02D 27/42 405/252
5,501,429 A * 3/1996 Sakuma ..... E01F 13/028 256/1
5,625,988 A * 5/1997 Killick ..... E04H 12/2269 248/156
5,895,169 A * 4/1999 Holm ..... E01F 9/685 248/156
5,961,249 A * 10/1999 Hansen ..... E01F 13/026 404/6
6,821,050 B1 * 11/2004 Maldonado ..... E01F 13/046 404/6
7,249,910 B2 * 7/2007 Eckert ..... E01F 9/685 248/158
7,374,363 B2 * 5/2008 Bousson, Sr. ..... E01F 13/026 404/10

(Continued)

*Primary Examiner* — Abigail A Risic
(74) *Attorney, Agent, or Firm* — Parsons Behle & Latimer

(57) ABSTRACT

A method of restricting access to an area comprises removing a plug from a receptacle in a ground region and positioning a base of a security barrier into the receptacle after the removing the plug. The receptacle extends downward from a surface of the ground region. The security barrier includes a tower extending upward from the base. The security barrier restricts movement of vehicles across the ground region when the base is received within the receptacle and the plug does not restrict movement of vehicles across the ground region when the plug is received within the receptacle. The plug has a first shape and the base of the security barrier has a second shape corresponding to the first shape of the plug. The first shape and the second shape are interchangeably receivable within the receptacle for selectively restricting movement across the ground region.

24 Claims, 3 Drawing Sheets

(56) References Cited

U.S. PATENT DOCUMENTS

| | | | | |
|---|---|---|---|---|
| 7,472,891 | B2 * | 1/2009 | Schram | E01F 13/046 256/65.14 |
| 8,226,321 | B2 * | 7/2012 | Meyers | E01F 15/003 404/6 |
| 2005/0249553 | A1 * | 11/2005 | Eckert | E01F 9/685 404/9 |
| 2006/0236647 | A1 * | 10/2006 | Fehr | E04C 3/30 405/262 |
| 2008/0296462 | A1 * | 12/2008 | Siu | E01F 9/681 248/519 |
| 2009/0035061 | A1 * | 2/2009 | Crawford | E01F 13/026 404/6 |
| 2010/0059187 | A1 * | 3/2010 | Moore | E01F 13/028 160/351 |
| 2010/0281791 | A1 * | 11/2010 | Intagliata | E04H 12/2261 52/127.12 |
| 2011/0280656 | A1 * | 11/2011 | Meyers | E01F 15/003 404/6 |
| 2013/0192149 | A1 * | 8/2013 | Roach | E01F 13/026 52/165 |
| 2015/0147120 | A1 * | 5/2015 | Adler | E02B 3/108 405/116 |

* cited by examiner

SECURITY BARRIER AND METHODS

BACKGROUND

Field of the Disclosure

The embodiments described herein relate generally to apparatuses, methods, and systems for restricting access to an area by vehicle or other traffic. More particularly, the disclosure relates to portable security barriers.

Description of the Related Art

Security barriers are increasingly needed in light of the unpredictability of events around the world. For instance, security barriers may be installed along public areas such as sidewalks to stop vehicles from traveling into these areas and/or into buildings. Among the most common types of temporary barriers are jersey barriers, which can be positioned via a forklift or crane. Security barriers may be characterized as an active barrier, that opens and closes to allow access, or passive barriers that remain closed until removed and/or uninstalled. Examples of active barriers may include a wedge barrier that has a moveable angled metal plate positioned toward approaching vehicles, a beam barrier that swings or telescopes to restrict passage, bollards that are vertical cylinders capable of being retracted into the ground, and wheeled barriers.

Security barriers may be unsightly and expensive to install. Furthermore, the installation of security barriers may be discouraged to the extent that they conflict with the surrounding architecture. Other disadvantages of known security barriers may exist.

SUMMARY

The present disclosure is directed to security barriers and methods of restricting access to areas that overcome some of the problems and disadvantages discussed above.

An embodiment of a method of restricting access to an area comprises removing a plug from a receptacle in a ground region and positioning a base of a security barrier into the receptacle after the removing the plug. The receptacle extends downward from a surface of the ground region. The security barrier includes a tower extending upward from the base, and the tower restricts movement across the ground region. The tower may extend at least thirty inches above the surface of the ground region when the base of the security barrier is in the receptacle. The tower may include a plurality of sides along a height of the tower. At least one of the sides may be oriented at an acute angle with respect to the surface of the ground region when the base of the security barrier is positioned in the receptacle.

The method may include removing the base of the security barrier from the receptacle after the positioning the base. The method may include positioning one of the plug or another plug into the receptacle after the removing the base. The ground region may be a roadway positioned to receive vehicle traffic and the plug may not restrict movement of vehicles across the roadway. The ground region may be a sidewalk positioned to receive pedestrian traffic. The method may include removing a portion of the ground region to form the receptacle.

The plug may include a body having a top surface that does not extend above the surface of the ground region when the plug is in the receptacle. The receptacle has a first depth and the plug has a first height, and the first height may be equal to the first depth. The base of the security barrier may have a top surface and a bottom surface with a second height therebetween, the second height being equal to the first depth of the receptacle. The first depth may be at least eighteen inches. The body of the plug may include a plurality of sides and the plug may include a plurality of perimeter supports positioned at intersections of the top surface with the plurality of sides. The plug may include a plurality of side supports positioned at intersections of the plurality of sides. The body of the plug may comprise reinforced concrete. The perimeter supports may comprise a metal. The metal may be aluminum.

An embodiment of a system for restricting access to an area includes a plug and a security barrier. The plug has a first height and a first shape. The security barrier has a base and a tower. The tower extends upward from the base. The base has a second height and a second shape, the second shape corresponding to the first shape of the plug. The first shape and the second shape are interchangeably receivable within a receptacle in a ground region for selectively restricting movement across the ground region. The security barrier restricts movement of vehicles across the ground region when the base is received within the receptacle and the first height of the plug does not restrict movement of vehicles across the ground region when the plug is received within the receptacle.

The first height and the second height may each be at least eighteen inches. The tower may extend upward from the base at least thirty inches. The plug may include a top surface, a plurality of sides, a plurality of perimeter supports positioned at intersections of the top surface with the plurality of sides, and/or a plurality of side supports positioned at intersections of the plurality of sides.

An embodiment of a removable security barrier for restricting access to an area includes a base and a tower. The base has a bottom surface, a top surface, and a plurality of sides. The base is configured to be received within a receptacle in a ground region. The tower extends upward from the base. The base has a height of at least thirty inches and a plurality of sides. At least one of the plurality of sides of the tower is oriented at an acute angle with respect to the top surface of the base. The security barrier restricts movement across the ground region when the base is positioned within the receptacle.

As used herein, a security barrier is a vehicle-impact rated barrier, which is designed to stop or at least considerably slow a vehicle upon impact. Security barriers are often found in areas, such as military bases or buildings, wherein unauthorized access by vehicle would comprise security or endanger persons in the area. Examples of security barriers include barriers that would be rated under U.S. Department of State SD-STD-02.01 standard, CWA 16221:2010, ASTM F2656-07, PAS 68:2013, or ISO IWA 14-1: 2013 for a desired application. For instance, a security barrier positioned outside a military base may require a greater rating than a security barrier for a parking lot or a concert venue. Furthermore, it is appreciated that while these security barriers may restrict access to an area, it is often impractical to completely prevent access.

Figure 1:
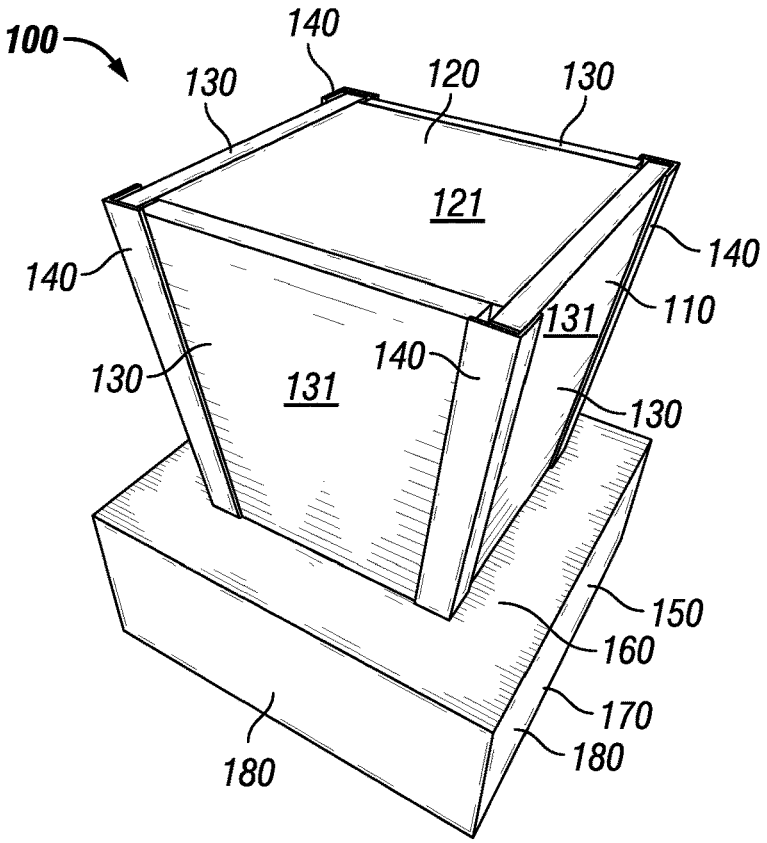
FIG. 1 shows an embodiment of a security barrier.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the scope of the disclosure as defined by the appended claims.

DETAILED DESCRIPTION

FIG. 1 shows an embodiment of a security barrier 100. The security barrier 100 includes a base 150 and a tower 110 extending upward from the base 150. In the following description, unless otherwise indicated, directional terms, such as above, below, up, down, etc. are with reference to the orientation of structure shown in the figures, and down is considered to be aligned with gravitational forces. Also, as used herein, the term "substantially" means at least almost entirely. In quantitative terms, "substantially" means at least 80% of a stated reference (e.g., quantity of shape). The base 150 includes a top surface 160, a bottom surface 170, and a plurality of sides 180 between the top surface 160 and the bottom surface 170. In use, the security barrier 100 is supported upon the bottom surface 170 of the base 150. The base 150 may comprise exactly four sides 180. In some embodiments, the number of sides 180 may be varied depending on the application as would be appreciated by one of ordinary skill in the art having the benefit of this disclosure. The sides 180 of the base 150 form a shape that corresponds with a receptacle 15 (shown in FIG. 5) in the ground such that the base 150 can be received within the receptacle 15 and the tower 110 extends upward from the ground to restrict movement across the area. The base 150 may be comprised of reinforced concrete. In some embodiments, the base 150 may be comprised of metal. The base 150 may not be hollow. In other words, the base 150 may lack an interior cavity or bottom opening.

The tower 110 includes a top 120 and a plurality of sides 130 extending between the top 120 and the top surface 160 of the base 150. The tower 110 may comprise exactly four sides 130. In some embodiments, the number of sides 130 may be varied depending on the application as would be appreciated by one of ordinary skill in the art having the benefit of this disclosure. The tower 110 may include a plurality of side supports 140 positioned at intersections of the sides 130. The side supports 140 may be formed of angled metal that contacts both of the intersecting sides 130. The metal may be aluminum. A majority of an outer surface 131 of the side 130 may still be visible between the side supports 140. The tower 110 may be comprised of reinforced concrete. The tower 110 may be integral to the base 150.

In some embodiments, the sides 130 may be panels of a different material than a body 111 (shown in FIG. 3) of the tower 110. The body 111 of the tower 110 may be comprised of reinforced concrete. The sides 130 may be comprised of various materials. For example, the sides 130 may comprise, but are not limited to, wood, natural stone, artificial stone, metal, or a combination thereof. The sides 130 may include an outer surface 131 with a decorative surface. The decorative surface may be a surface that appears to be a material other than concrete. The top 120 may be a panel of a different material than the body 111 of the tower 110. The top 120 may comprise wood, natural stone, artificial stone, metal, or a combination thereof. The top 120 may include an outer surface 121 with a decorative surface that appears to be a material other than concrete. By way of example, the top 120 and/or sides 130 may be comprised of an artificial stone slab as described in U.S. Pat. No. 10,161,138 titled "Artificial Stone Construction Material and Method of Making," the entirety of which is incorporated herein by reference. The artificial stone slab comprises layers formed of stone pieces, cement, and glue with adjacent layers separated by metal mesh. The stone pieces of a color layer may be a stone powder having a particle size less than or equal to 200 mesh. One or more backing layers may have larger stone pieces mixed with stone powder. The preferred metal mesh is an expanded sheet of aluminum that has diamond shaped holes which are approximately ¼ inch from side to side. This provides some reinforcement between the layers and gives the tile rigidity yet retaining flexibility. Other types of mesh could also be used such as woven metal mesh. The first backing layer may have larger pieces of stone in it, such as ⅛ inch. Additional backing layers may be used, and each backing layer would have larger stones mixed with stone powder. A second backing layer would typically have stone particles of ¼ inch, a third backing layer would have stone particles of ⅜ inch, and a fourth backing layer would have stone particles of ½ inch. The first backing layer is added on top of the metal mesh layer, and the presence of the metal mesh layer between the color layer and the backing layer prevents the two layers from freely intermixing. Thus the color layer will not be disturbed by or blended into the backing layer. The two layers in the metal mesh are allowed to dry in the mold for approximately 24-48 hours, at which time the artificial stone tile may be removed from the mold by turning the mold upside down and applying a minimal amount of impact. The preferred thickness of the color layer is approximately ¼ inch thick, which is the same preferred thickness as the thickness of the backing layer. Additional layers can be added by adding a second metal mesh layer on top of the backing layer, and adding a second backing layer on top of the second metal mesh layer. In this way, slabs or tiles can be ½ inch, ¾ inch, 1 inch, 1¼ inch, etc. up to whatever thickness is desired. The ½ half inch thick slab would have three layers: color, metal mesh, and backing. The ¾ inch thick slab would have five layers, to the half inch thick slab would be added a second metal mesh layer and a second ¼ inch backing layer. In this way increments of ¼ inch can easily be added, and retain the flexibility of the ½ inch slab as well as lightweight and nailability. When cured, the stone slab thus created may be polished with sandpaper to have a smooth and hard surface, similar to marble in hardness and appearance.

By way of example, the base 150 may have a square shape with equal side lengths. The length of each side of the base 150 may be approximately forty-eight inches. The base 150 may have a height, between the top surface 160 and the bottom surface 170, of eighteen inches or more. The tower 110 may have a height, between the top surface 160 of the base 150 and the top 120 of the tower 110, of thirty inches or more. In some embodiments, the tower 110 may have a height of thirty-six inches or more. The tower 110 may increase in cross-sectional area as it extends above the base 150. For example, the tower 110 may have an inverted truncated square pyramid shape that increases from between twenty-six and thirty inches near the top surface 160 of the base 150 to between thirty-two and thirty-six inches at the top 120 of the tower 110. The sides 130 may have a thickness of approximately two inches between the outer surface 131 and an inner surface 132 (shown in FIG. 3). The sides 130 may have a height that is greater than a height of the body 111 of the tower 110. The height of the sides 130 may be less than six inches greater than the height of the body 111 of the tower 110. For example, the height of the body 111 of the tower 110 may be thirty inches and the sides may have a height of thirty-six inches. The top 120 may have a thickness of approximately two inches between the outer surface 121 and an inner surface 122 (shown in FIG. 3).

Figure 2:
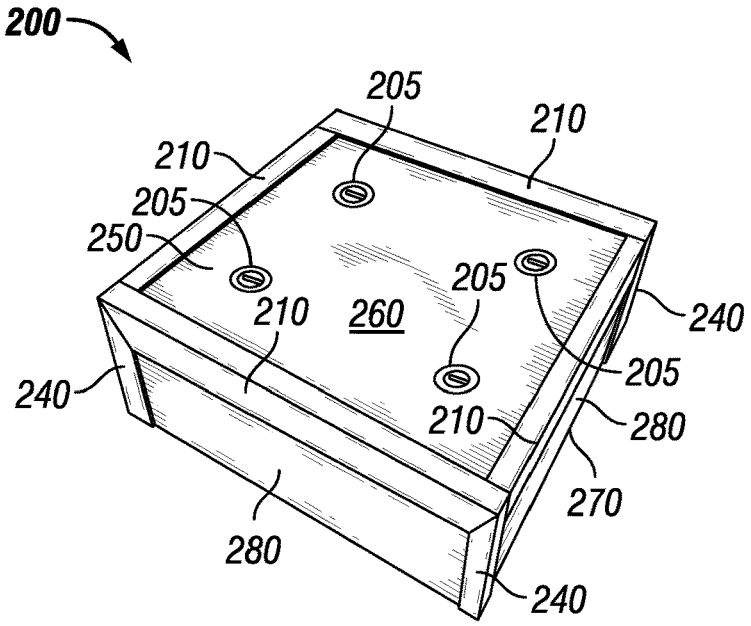
FIG. 2 shows an embodiment of a plug configured to be used in conjunction with and interchangeable to the embodiment of the security barrier shown in FIG. 1.

FIG. 2 shows an embodiment of a plug 200 configured to be used in conjunction with the security barrier 100 shown in FIG. 1. The plug 200 is interchangeable with the security barrier 100 in order to restore access to an area when the security barrier 100 is not positioned within the receptacle 25 (shown in FIG. 5) in the ground. The plug 200 includes a top surface 260, a bottom surface 270, and a plurality of sides 280 between the top surface 260 and the bottom surface 270. A body 250 of the plug 200 is formed between the top surface 260, bottom surface 270, and the plurality of sides 280. In use, the plug 200 is supported upon its bottom surface 270. The plug 200 may comprise exactly four sides 280. The sides 280 form a shape that corresponds with a receptacle 25 (not shown in FIG. 2) in the ground such that the plug 200 can be received within the receptacle 25. By way of example, the plug 200 may have a square shape with equal side lengths. The length of each side of the plug 200 may be approximately forty-eight inches. A height of the plug 200 may be selected such that the top surface 260 is aligned or substantially aligned with the ground when the plug 200 is positioned within the receptacle 25. By way of example, the plug 200 may include a plurality of recessed anchors 205 and the anchors 205 may be covered with a lid (not shown) to provide access to the anchors 205 for lifting the plug 200 in and out of the receptacle 25. The body 250 of the plug 200 may be comprised of reinforced concrete. In some embodiments, the body 250 of the plug 200 may be comprised of metal. The plug 200 may have a height, between the top surface 260 and the bottom surface 270, of eighteen inches or more. The plug 200 may not be hollow. In other words, the body 250 of the plug 200 may lack an interior cavity or bottom opening.

The plug 200 may include a plurality of side supports 240 positioned at intersections of the sides 280 of the body 250. The side supports 240 may be formed of angled metal that contacts both of the intersecting sides 280. The metal may be aluminum. The plug 200 may include a plurality of perimeter supports 210 positioned at intersections of the top surface 260 with the plurality of sides 280 of the body 250. The perimeter supports 210 may be formed of angled metal that contacts the intersecting side 280 and top surface 260. The metal may be aluminum. A majority of the side 280 may still be visible between the perimeter supports 210 and the side supports 240.

Figure 3:
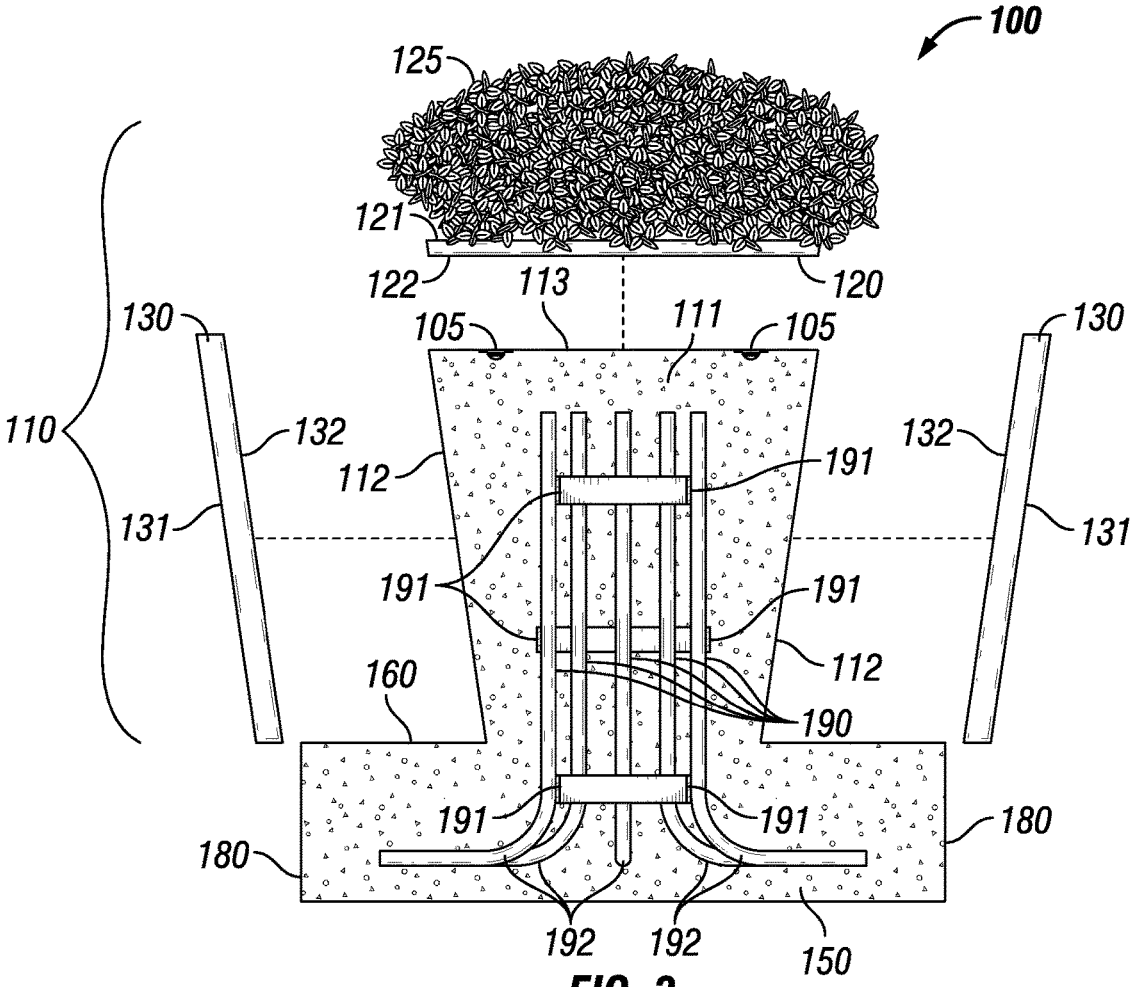
FIG. 3 is a cross-sectional exploded view of the embodiment of the security barrier shown in FIG. 1.
Figure 4:
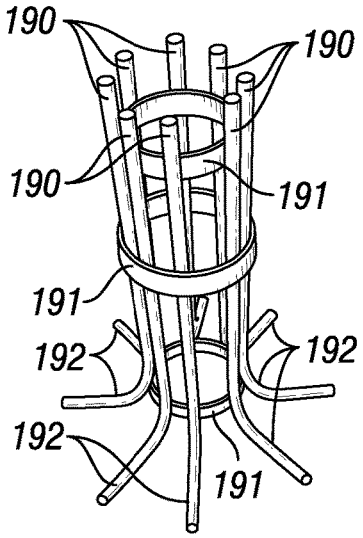
FIG. 4 is an embodiment of an internal support for a security barrier.

FIG. 3 shows a cross-sectional exploded view of the security barrier 100 with an artificial plant 125 covering the top 120. The artificial plant 125 or another decorative feature may be used to conceal the nature of the security barrier 100. The security barrier 100 may include internal supports 190 that are oriented along the height of the tower 110 and into the base 150. For the purposes of illustration, the cross-sectional view of supports 190 has been exaggerated in FIG. 3. Furthermore, other embodiments and configurations may be utilized to reinforce the base 150 and tower 110 of the security barrier 100. For example, rebar may be woven together in a grid and/or rebar bands may be welded to other lengths of rebar. FIG. 4 shows an embodiment of the internal supports 190. The internal supports 190 may extend substantially vertically within the tower 110 and include a plurality of support rings 191 interconnecting the supports 190. The supports 190 may include legs 192 that extend outward and into the base 150 of the security barrier 100. The supports 190 may be oriented in a circular configuration by the support rings 191. In some embodiments, the supports 190 are positioned within the support rings 191. In some embodiments, the supports 190 are positioned outside the support rings 191. In other embodiments, the supports 190 may be positioned within some support rings 191 and positioned outside other support rings 191. For instance, the supports 190 may be welded or connected to an outside surface of upper and lower support rings 191 and the supports 190 may be welded or connected to an interior surface of a middle support ring 191 that is between the upper and lower support rings 191, or vice versa. Weaving supports 190 with this alternating positioning with respect to the support rings 191 may provide additional rigidity and strength. Adjacent supports 190 may be weaved in opposite directions. The supports 190 may be formed of rebar. The rebar may be carbon steel rebar, galvanized rebar, epoxy-coated rebar, glass-fiber-reinforced-polymer rebar, or combinations thereof.

Referring again to FIG. 3, the security barrier 100 includes sides 130 that attach to side portions 112 of the body 111 of the tower 110. The sides 130 include an inner surface 132 opposite from the outer surface 131. The inner surface 132 may be secured to a side portion 112 of the body 111 of the tower 110. For instance, the sides 130 may be secured via an adhesive or layer of silicone between the inner surface 132 and the side portion 112 of the tower 110. In some embodiments, fasteners, such as nails, may extend through the sides 130 and into the tower 110. In some embodiments, silicone may be preferred to increase the structural stability of the tower 110 against an impact, as would be appreciated by one of ordinary skill in the art having the benefit of this disclosure. One or more, and in some embodiments all, of the sides 130 may be oriented at an acute angle with respect to the top surface 160 of the base 150 and/or with respect to the surface of the ground when the base 150 is positioned within a receptacle in the ground. Sides 130 have a larger angular magnitude may assist with deflecting forces, such as a vehicle driving into the sides 130, downward into the security barrier 100.

The security barrier 100 may include a removable top 120 having an outer surface 121 and an inner surface 122 opposite the outer surface 121. The inner surface 122 may be positioned adjacent to a top portion 113 of the body 111 of the tower 110. In some embodiments, the top 120 may be secured to the body 111 of the tower 110 via an adhesive, layer of silicone, or fasteners. The top 120 may include an artificial plant 125 the resides above the body 111 of the tower 110 when the security barrier 100 is in use. The top 120 may be removable to facilitate connection of the security barrier 100 to a top portion of the internal supports 190 or anchors 105, such as hooks, for lifting the security barrier 100 into place. By way of example, the body 111 of the tower 110 may include a plurality of recessed anchors 105 and the anchors 105 may be covered by the top 120, which is removable to provide access to the anchors 105 for lifting the security barrier 100 in and out of the receptacle 15. The depth of any cavity created between the top 120 and the body 111 of the tower 110 and/or the height of the artificial plant 125 may be limited to six inches or less to inhibit placement of unsecure items that may comprise the security barrier 100.

Figure 5:
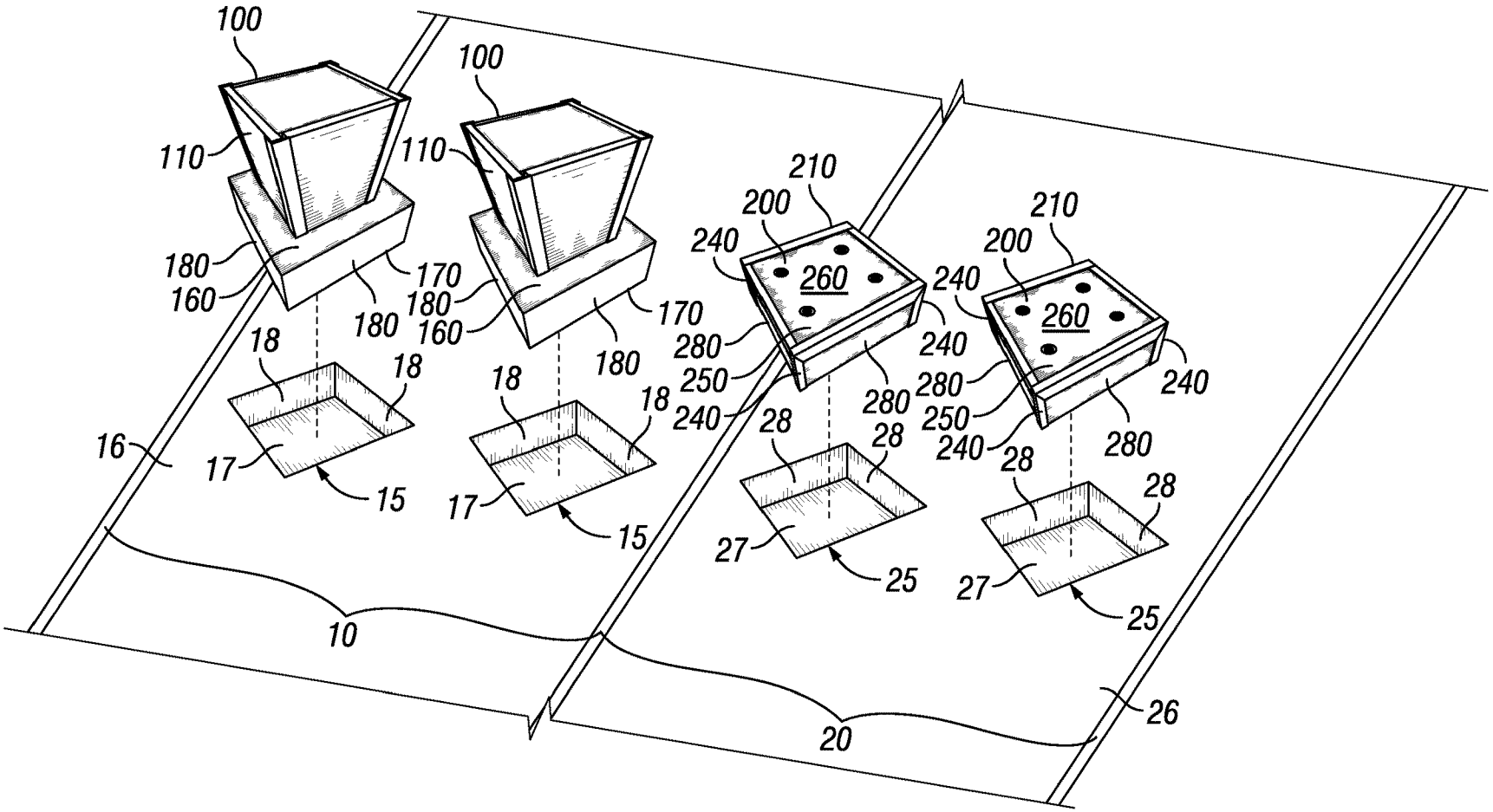
FIG. 5 is an illustration of security barriers and plugs selectively restricting access to an area.

FIG. 5 is an illustration of a pair of security barriers 100 impeding movement across a first ground region 10 and a pair of plugs 200 allowing movement across a second ground region 20. As illustrated, ground regions 10 and 20 are adjacent lanes of a roadway, however additional application could include opposing ends of a roadway or sidewalk, for example. In the first ground region 10, a plurality of receptacles 15 have been formed. The receptacles 15 include a bottom surface 17 and a plurality of side surfaces 18 that form an opening terminating at the surface 16 of the ground region 10. The receptacle 15 may have a depth, from the surface 16 of the ground region 10 to the bottom surface 17, of eighteen inches or more. A security barrier 100 is received into each receptacle 15 such that the bottom surface 170 of the base 150 of the security barrier 100 is supported upon the bottom surface 17 of the receptacle 15. The sides 180 of the base 150 of the security barrier 100 are positioned adjacent to the side surfaces 18 of the receptacle 15. The base 150 may be of substantially the same size as the receptacle 15 while still allowing the security barrier 100 to be removed from within the receptacle 15 without damaging the ground region 10. The plurality of receptacles 15 may be positioned in an array to impede movement across the ground region 10. For instance, two or more receptacles 15 may extend across the width of a lane in a roadway to temporarily restrict access. Staggered receptacles 15 may be used to impede access of smaller vehicles while still allowing pedestrian traffic. A diagonal array of receptacles 15 may be used to cause traffic to merge into an adjacent lane. With the security barrier 100 positioned within the receptacle 15, the top surface 160 of the base 150 may be aligned or substantially aligned with the surface 16 of the ground region 10.

In the second ground region 20, a plurality of receptacles 25 have been formed. The receptacles 25 include a bottom surface 27 and a plurality of side surfaces 28 that form an opening terminating at the surface 26 of the ground region 20. The receptacle 25 may have a depth, from the surface 26 of the ground region 20 to the bottom surface 27, of eighteen inches or more. A plug 200 is received into each receptacles 25 such that the bottom surface 170 of the plug 200 is supported upon the bottom surface 27 of the receptacle 25. The sides 280 of the plug 200 are positioned adjacent to the side surfaces 28 of the receptacle 25. The plug 200 may be of substantially the same size as the receptacle 25 while still allowing the plug 200 to be removed from within the receptacle 25 without damaging the ground region 20. With the plug 200 positioned with the receptacle 25, the top surface 260 of the plug 200 may be aligned or substantially aligned with the surface 26 of the ground region 20 such that the plug 200 does not restrict movement of vehicles across the ground region 20. In some instances, the top surface 260 of the plug 200 does not extend above the surface 26 of the ground region 20. The receptacles 25 in the second ground region 20 may have dimensions equal to the receptacles 15 in the first ground region 10. The securities barriers 100 and the plugs 200 are interchangeably receivable within the receptacles 15, 25 for selectively restricting movement across their respective ground regions 10, 20.

The ground regions 10, 20 may be a roadway that receives vehicle traffic. In some instances, the ground regions 10, 20 may be a sidewalk that receives pedestrian traffic. With the plug 200 positioned in the receptacle 25, vehicles can travel over the plug 200. The perimeter supports 210 and side supports 240 may reduce the risk that the plug 200 or ground region 20 is damaged when in use. In addition, the plug 200 provides support for the traffic thereon.

A user may selectively restrict access to an area by exchanging a security barrier 100 for a plug 200. For instance, when an event is taking place on a roadway, a user may positioned security barriers 100 to restrict access to the roadway during the event. A security barrier 100 having one or more sides 130 with a particular decorative design may be selected to match the location that is being restricted. Once the event has been completed, the security barriers 100 may be removed and replaced with plugs 200 such that access across the roadway is restored. Existing areas may be retrofitted to accept a system of security barriers 100 and plugs 200 by cutting receptacles into a desired ground region. In other instances, receptacles may be formed when the ground region is initially being created.

A user, desiring to restrict access to ground region 20 may remove the plugs 200 from the receptacles 25. Additional security barriers 100 may be transported to the location and the base 150 of each security barrier 100 is positioned into one of the receptacles 25. The tower 110 of the security barrier 100 extends upward from the surface 26 of the ground region 20 and restricts movement across the ground region 20. When it is desired to remove the restriction across both ground region 10 and ground region 20, the base 150 of each security barrier 100 may be removed from the receptacles 15, 25 and the same plugs 200 or similar plugs 200 may be positioned into the receptacles 15, 25. In the case of a roadway, the plugs 200 do not restrict movement of vehicles across the roadway. In the case of a sidewalk, plugs 200 do not restrict movement of pedestrians across the sidewalk. In some instances, the plugs 200 may be decorative features, such as stone planters, that can be removed and replaced when a security barrier 100 is desired to be positioned.

Although this disclosure has been described in terms of certain embodiments, other embodiments that are apparent to those of ordinary skill in the art, including embodiments that do not provide all of the features and advantages set forth herein, are also within the scope of this disclosure. Accordingly, the scope of the present disclosure is defined only by reference to the appended claims and equivalents thereof.

What is claimed is:

1. A method of restricting access to an area, the method comprising:

removing a plug from a receptacle in a ground region, the receptacle extending downward from a surface of the ground region; and positioning a base of a security barrier into the receptacle after the removing the plug, wherein the security barrier includes a tower having a body extending upward from the base and sides attached to the body, the body having a height and a top, the sides forming a cavity above the top of the body having depth of six inches or less, the sides formed of an artificial stone, the artificial stone having layers formed of stone pieces, cement, and glue with adjacent layers separated by metal mesh, the tower restricting movement across the ground region, the security barrier being a vehicle-impact rated barrier.

2. The method of claim 1, further comprising:

removing the base of the security barrier from the receptacle after the positioning the base; and positioning one of the plug or another plug into the receptacle after the removing the base.

3. The method of claim 2, wherein the ground region is a roadway positioned to receive vehicle traffic and the plug does not restrict movement of vehicles across the roadway.

4. The method of claim 2, wherein the ground region is a sidewalk positioned to receive pedestrian traffic.

5. The method of claim 2, further comprising removing a portion of the ground region to form the receptacle.

6. The method of claim 2, wherein the plug includes a body having a top surface that does not extend above the surface of the ground region when the plug is in the receptacle.

7. The method of claim 6, wherein the receptacle has a first depth and the plug has a first height, the first height being equal to the first depth.

8. The method of claim 7, wherein the base of the security barrier has a top surface and a bottom surface with a second height therebetween, the second height being equal to the first depth of the receptacle.

9. The method of claim 7, wherein the first depth is at least eighteen inches.

10. The method of claim 6, wherein the body of the plug includes a plurality of sides and the plug includes a plurality of perimeter supports positioned at intersections of the top surface with the plurality of sides.

11. The method of claim 10, wherein the plug further comprises a plurality of side supports positioned at intersections of the plurality of sides.

12. The method of claim 10, wherein the body of the plug comprises reinforced concrete.

13. The method of claim 12, wherein the perimeter supports comprise a metal.

14. The method of claim 2, wherein the tower extends at least thirty inches above the surface of the ground region when the base of the security barrier is in the receptacle.

15. The method of claim 2, wherein the tower includes a plurality of sides along a height of the tower, at least one of the sides being oriented at an acute angle with respect to the surface of the ground region when the base of the security barrier is positioned in the receptacle.

16. A system for restricting access to an area, the system comprising:

a plug having a first height and a first shape, wherein the plug includes a top surface, a plurality of sides, a plurality of perimeter supports positioned at intersections of the top surface with the plurality of sides, and a plurality of side supports positioned at intersections of the plurality of sides; and a security barrier having a base and a tower, the tower extending upward from the base, the base having a second height and a second shape, the second shape corresponding to the first shape of the plug, wherein the first shape and the second shape are interchangeably receivable within a receptacle in a ground region for selectively restricting movement across the ground region, and the security barrier restricts movement of vehicles across the ground region when the base is received within the receptacle and the first height of the plug does not restrict movement of vehicles across the ground region when the plug is received within the receptacle, the security barrier being a vehicle-impact rated barrier.

17. The system of claim 16, wherein the first height and the second height are each at least eighteen inches.

18. The system of claim 17, wherein the tower extends upward from the base at least thirty inches.

19. A removeable security barrier for restricting access to an area, the security barrier comprising:

a base shaped to be received within a receptacle in a ground region; and a tower having a body extending upward from the base and sides attached to the body, the body having a height and a top, the sides forming a cavity above the top of the body having depth of six inches or less, the sides formed of an artificial stone, the artificial stone having layers formed of stone pieces, cement, and glue with adjacent layers separated by metal mesh, wherein the security barrier restricts movement across the ground region when the base is positioned within the receptacle, the security barrier being a vehicle-impact rated barrier.

20. The removable security barrier of claim 19, wherein the sides are panels formed of a different material than the body.

21. The removable security barrier of claim 20, wherein the panels have a thickness of approximately two inches.

22. The removable security barrier of claim 20, further comprising a plurality of side supports positioned at intersections of the sides.

23. The removeable security barrier of claim 19, wherein the cross-sectional area of the tower increases along the height of the tower from the base, the sides being oriented at an acute angle with respect to the ground region when positioned within the receptacle in the ground.

24. The removeable security barrier of claim 19, wherein the top of the body includes anchors operable for lifting the security barrier in and out of the receptacle.

* * * * *